US007249577B1

(12) United States Patent
Zhang et al.

(10) Patent No.: US 7,249,577 B1
(45) Date of Patent: Jul. 31, 2007

(54) CONNECTING ROD WITH OIL SQUIRTER

(75) Inventors: Jian Jun Zhang, Oakland Township, MI (US); Ko-Jen Wu, Troy, MI (US); Xiaofei Jiang, Troy, MI (US); Jennifer M. Stanek, Clarkston, MI (US)

(73) Assignee: GM Global Technology Operations, Inc., Detroit, MI (US)

( * ) Notice: Subject to any disclaimer, the term of this patent is extended or adjusted under 35 U.S.C. 154(b) by 0 days.

(21) Appl. No.: 11/375,431

(22) Filed: Mar. 14, 2006

(51) Int. Cl.
*F01P 1/04* (2006.01)

(52) U.S. Cl. ..... 123/41.35

(58) Field of Classification Search ... 123/41.35–41.38
See application file for complete search history.

(56) References Cited

U.S. PATENT DOCUMENTS 4,508,065 A 4/1985 Suchdev
5,533,472 A * 7/1996 Sands et al. ..... 123/41.35
6,481,389 B2 * 11/2002 Suzuki et al. ..... 123/41.35
6,955,142 B2 10/2005 Patel et al.

* cited by examiner

*Primary Examiner*—Stephen K. Cronin
*Assistant Examiner*—Hyder Ali

(57) ABSTRACT

A connecting rod includes a connecting rod body having a crank arm bore portion at a first end and a pin bore portion at a second end. A beam portion connects the crank arm bore portion and the pin bore portion. At least one oil squirter is provided within the crank arm bore portion. The oil squirter operates to selectively communicate oil to the underside of a piston. One of the oil squirters is a plain orifice oil squirter or a check valve regulated oil squirter.

15 Claims, 2 Drawing Sheets

CONNECTING ROD WITH OIL SQUIRTER

TECHNICAL FIELD

The present invention relates to connecting rods within internal combustion engines.

BACKGROUND OF THE INVENTION

A piston within an internal combustion engine must dissipate the heat energy it absorbs, during each engine cycle, from the conversion of chemical energy into heat energy and finally into mechanical work.

Pistons are commonly made from aluminum or iron alloys. A piston typically has a crown portion with an upper surface exposed to engine combustion and the temperatures associated therewith. An undercrown portion of the piston is exposed to crankcase fluids. A ring belt, carrying compression and oil control rings, depends or extends from the crown portion. A piston skirt portion, having generally curved sidewalls, extends from the ring belt portion to provide a reaction force to counter the thrust forces exerted on the piston. A pin boss may extend between the skirt sidewalls for receiving a wrist pin for connection with a connecting rod.

In operation, the piston crown portion absorbs heat energy from an engine combustion chamber. The heat energy absorbed by the crown portion is conducted through the piston to the undercrown portion, the ring belt, and the skirt portion. Heat energy within the ring belt and skirt portion is conducted to the associated engine cylinder bore by direct contact and through the piston rings. The heat energy within the undercrown portion is transferred to the ring belt or dissipated to crankcase fluids, including air, oil vapor, and liquid oil present in the engine. By increasing the amount of liquid oil supplied to the undercrown portion of the piston, the operating temperature of the piston can be reduced, thereby increasing the durability of the piston and enabling increased engine performance.

SUMMARY OF THE INVENTION

Provided is a connecting rod, interconnectable to a crankshaft, having a connecting rod body including a crank arm bore portion at a first end and a pin bore portion at a second end. A beam portion connects the crank arm bore portion and the pin bore portion. At least one oil squirter is provided within the crank arm bore portion and operates to selectively communicate oil to the underside of a piston.

The crank arm bore portion may be mounted to a rod journal of the crankshaft via a journal bearing having at least one orifice defined therein. The crankshaft defines a passage operable to selectively communicate pressurized oil to the at least one orifice. Each of the orifices operates to communicate pressurized oil to a respective one of the oil squirters.

One of the at least one oil squirters may be a plain orifice squirter, which includes a generally tapering bore that operates to communicate pressurized oil to a generally cylindrical bore which, in turn, operates to communicate pressurized oil to a generally cylindrical nozzle portion. The generally cylindrical bore may have a greater radial dimension than the generally cylindrical nozzle portion.

Additionally, one of the at least one oil squirters may be a check valve regulated squirter. The check valve regulated squirter may include a spring biased ball member, which operates to selectively allow pressurized oil to pass when the pressure of the pressurized oil reaches a threshold value. The check valve regulated squirter may include a valve body having a generally cylindrical outer surface and a generally cylindrical bore defined therein. The generally cylindrical bore is sufficiently configured to contain a coil spring operable to bias the ball member against the valve body to selectively allow the flow of pressurized oil. The check valve regulated squirter may also include an expander pin that is insertable into the valve body and sufficiently configured to expand the generally cylindrical outer surface against the crank arm bore portion, thereby securing the check valve regulated squirter within the connecting rod.

The above features and advantages and other features and advantages of the present invention are readily apparent from the following detailed description of the best modes for carrying out the invention when taken in connection with the accompanying drawings.

DESCRIPTION OF THE PREFERRED EMBODIMENTS

Figure 1:
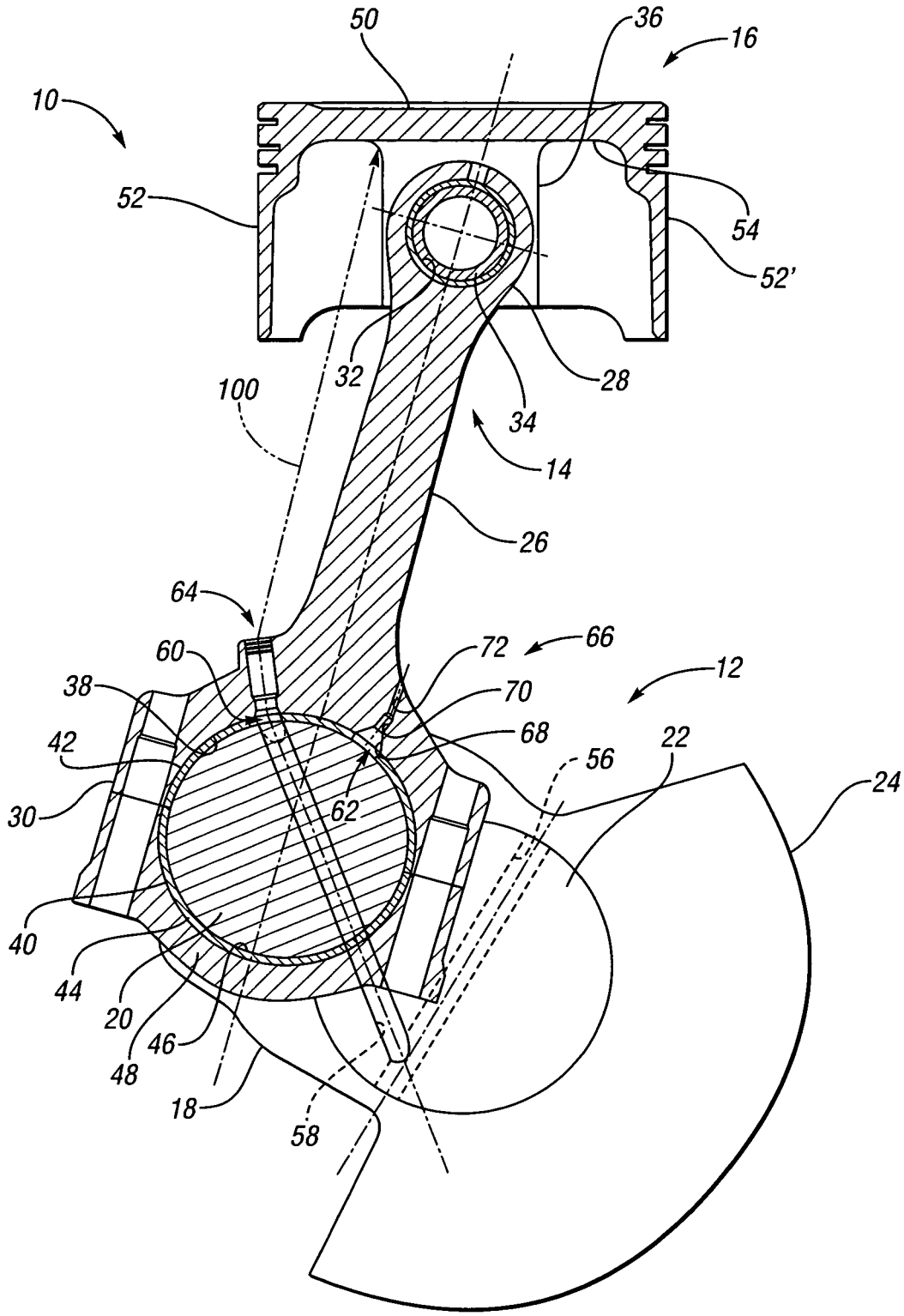
FIG. 1 is a schematic front cross sectional view of a connecting rod operatively connected to a piston and a crankshaft in accordance with the present invention.

Referring to the figures wherein like reference numbers correspond to similar components, there is shown in FIG. 1 a portion of an internal combustion engine 10, in accordance with the present invention, illustrating a crankshaft 12, connecting rod 12 and piston 16. The crankshaft 12 has a crank arm 18 that supports a rod journal 20. The crankshaft 14 includes a main journal 22 that rotatably supports the crankshaft 14 within an engine block, not shown. The rotational movement of the rod journal 20 actuates the connecting rod 14, which reciprocally translates the piston 16 within a cylinder bore of the engine 10. A counterweight 24 is provided on the crankshaft 14 to balance the inertia of the connecting rod 14 and piston 16.

The connecting rod 14 includes a beam portion 26 interconnecting a pin bore end portion 28 and a crank bore end portion 30. The pin bore end portion 28 defines a generally cylindrical pin bore 32 sufficiently dimensioned to receive a piston pin 34. The piston pin 34 rotatably engages a pin boss portion 36 of the piston 16 thereby mounting the piston 16 with respect to the connecting rod 14. The crank bore end portion 30 defines a generally cylindrical bore 38. The bore 38 is sufficiently dimensioned to receive a journal bearing 40. The journal bearing 40, in the preferred embodiment, is a two-piece design having an upper bearing shell 42 and a lower bearing shell 44. The upper and lower bearing shells 42 and 44 cooperate with the bore 38 to form a generally cylindrical crank bore 46. It should be noted that the upper and lower bearing shells 42 and 44 are fixed with respect to the bore 38. The crank bore 46 is sufficiently dimensioned to receive the rod journal 20 of the crankshaft 12. The crank bore end portion 30 of the connecting rod 14 includes a rod cap member 48 that is removably attached to the connecting rod 14 by known methods such as fastening. The rod cap member 48 facilitates the assembly of the connecting rod 14 onto the rod journal 20 of the crankshaft 12.

The piston 16 includes a crown portion 50 having skirt portions 52 and 52' depending or extending therefrom. The pin boss 36 is disposed intermediate the skirt portions 52 and 52'. The piston 16 further includes an undercrown portion 54. The crown portion 50 is exposed to the combustion process within the engine 10 and absorbs a portion of the heat energy from a combustion chamber. The heat energy absorbed by the crown portion 50 is conducted through the piston to the undercrown portion 54 and the skirt portions 52 and 52'. Heat energy within skirt portions 52 and 52' is conducted to the associated engine cylinder bore. The heat energy within the undercrown portion 54 is generally dissipated to crankcase fluids, including air, oil vapor, and liquid oil present within the engine crankcase. Additionally, the skirt portions 52 and 52' are provided to stabilize the piston 16 and to provide a reaction force to counteract the trust loads imparted on the piston 16 by the cylinder bore during the combustion process.

For lubrication, pressurized oil from the cylinder block enters a main journal passage 56, and passes through the main journal 22 of the crankshaft 12, through a passage 58 within the crank arm 18, and into the rod journal 20. From passage 58, the oil selectively passes into openings or orifices 60 and 62 defined by the upper bearing shell 42 when each of the orifices 60 and 62 align with the outlet of passage 58 during rotation of the crankshaft 12. The orifice 60 selectively communicates pressurized oil to a check valve regulated squirter assembly 64, while the orifice 62 selectively communicates pressurized oil to a plain orifice squirter 66 defined by the crank bore end portion 30 of the connecting rod 14. For the exemplary embodiment shown in FIG. 1, the check valve regulated squirter assembly 64 and the plain orifice squirter 66 are provided at 24 degrees from either side of the centerline of the connecting rod 14. Additionally, pressurized oil is provided to the plain orifice squirter 66 from 3 degrees before top dead center, or BTDC, to 21 degrees after top dead center, or ATDC of the stroke of piston 16. Similarly, pressurized oil is provided to the check valve regulated squirter assembly 64 from 66 degrees BTDC to 42 degrees BTDC of the stoke of piston 16. Those skilled in the art will recognize that the timing of pressurized oil supply to the check valve regulated squirter assembly 64 and the plain orifice squirter 66 may be varied by changing the size, shape and position of the orifices 60 and 62, respectively, while remaining within the scope of that which is claimed. In addition, it should be noted that care must be taken when selecting the size, shape, and location of the orifices 60 and 62 so as to not have a detrimental effect on the oil film thickness between the journal bearing 40 and the rod journal 20.

The plain orifice squirter 66 preferably includes a generally tapering bore 68 operable to communicate pressurized oil to a generally cylindrical bore 70. The bore 70 communicates pressurized oil to a nozzle portion 72. The nozzle portion 72 has a smaller diameter than the bore 70 such that fluid momentum of the pressurized oil is increased through the plain orifice squirter 66 to allow impingement of oil on the undercrown portion 54 of the piston 16. By providing an amount of oil to the undercrown portion 54, the plain orifice squirter 66 operates to cool the piston and lubricate the piston pin 34. In traditional types of connecting rods 14 such as, for example, forged steel or cast iron, the tapering bore 68, bore 70, and nozzle portion 72 may be formed by drilling or other methods of machining such as electrical discharge machining (EDM). The tapering bore 68, bore 70, and nozzle portion 72 may be formed integrally within powdered metal connecting rods during the manufacturing process.

Figure 2:
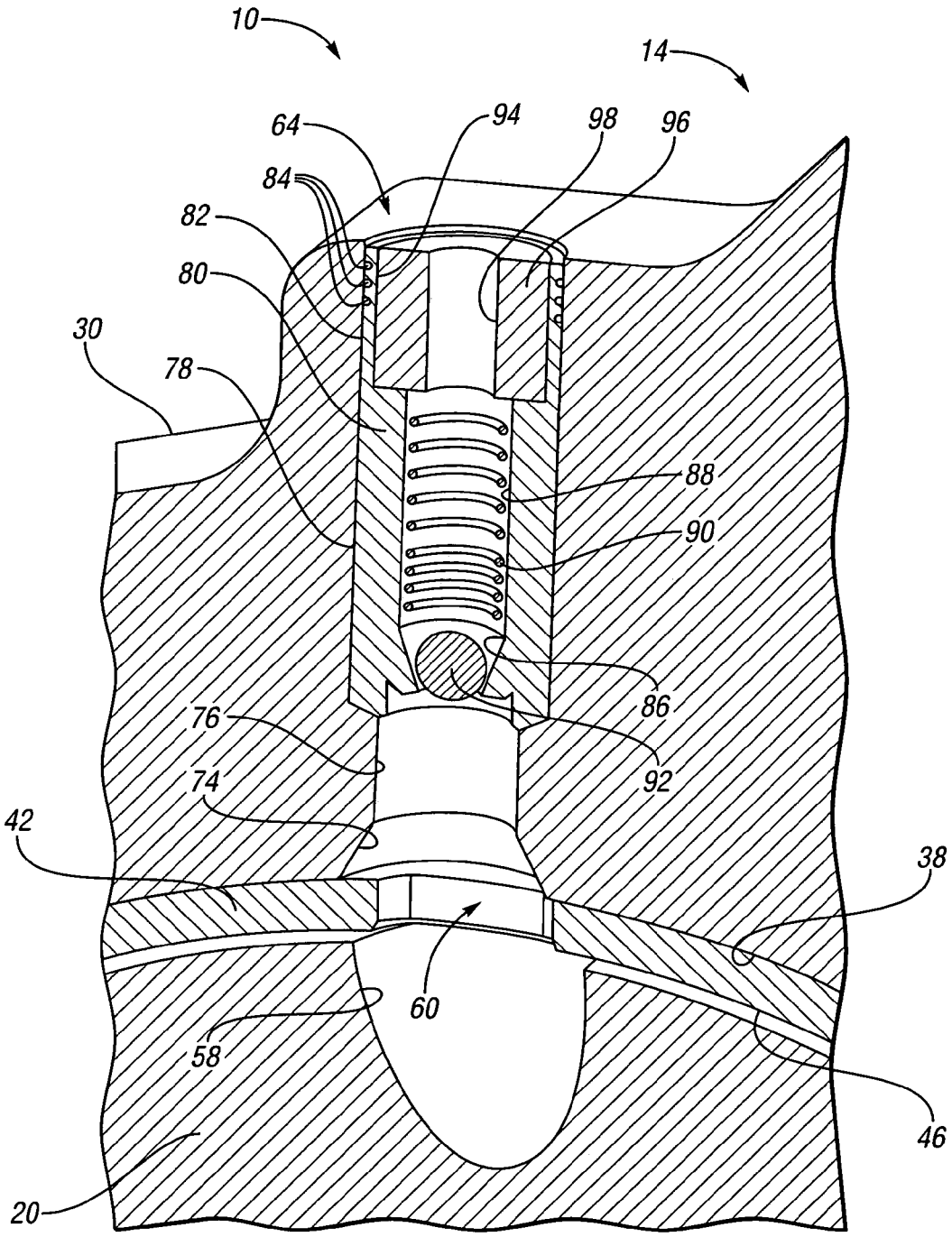
FIG. 2 is a schematic cross sectional view partially in elevation illustrating a check valve relief squirter assembly provided within the connecting rod shown in FIG. 1 in accordance with the present invention.

The check valve regulated squirter assembly 64 can best be described with reference to FIG. 2. In FIG. 2 there is shown a check valve regulated squirter assembly 64 installed in the connecting rod 14 and illustrating various aspects consistent with the present invention. A generally tapering bore 74 operates to communicate pressurized oil from the orifice 60 to a generally cylindrical bore 76. The bore 76 communicates pressurized oil to the check valve regulated squirter assembly 64. The check valve regulated squirter assembly 64 is installed in a generally cylindrical machined bore 78 defined by the crank bore end portion 30 of the connecting rod 14.

The check valve regulated squirter assembly 64 includes a valve body 80 having a generally cylindrical outer surface 82 with a plurality of grooves 84 formed thereon. The valve body 80 defines a generally diverging bore 86 opening to a generally cylindrical bore 88. The bore 88 has coil spring 90 disposed therein, which operates to bias a ball member 92 against the diverging bore 86. The valve body 80 also defines a generally cylindrical bore 94 sufficiently dimensioned to resist the insertion of an expander pin 96 within the valve body 80. By inserting the check valve regulated squirter assembly 64 into the machined bore 78 and subsequently forcing the expander pin 96 into the valve body 80, the outer surface 82 and the plurality of grooves 84 are expanded to engage the machined bore 78 thereby locking the check valve regulated squirter assembly 64 within the connecting rod 14. This is especially important as the centrifugal forces exerted on the check valve regulated squirter assembly 64 during rotation of the crankshaft 12 are high, and may cause the check valve regulated squirter assembly 64 to dislodge in the absence of a locking mechanism.

In operation, the pressurized oil from within the passage 58 passes through the orifice 60 and into the tapering bore 74. The pressurized oil then passes into the bore 76, and when the fluid pressure is sufficiently high enough to overcome the force of the coil spring 90 and dislodge the ball member 92, the pressurized oil will pass into the bore 88. Subsequently, the pressurized oil will pass through a generally cylindrical orifice 98, defined by the expander pin 96. The pressurized oil exits the orifice with sufficient fluid momentum to impinge on the undercrown portion 54 of the piston 16, as shown by a projected stream or path 100 of FIG. 1. The trajectory of the projected stream 100 is a vector resultant of both the velocity of the oil along the centerline of the respective squirter and the velocity of the connecting rod 14. By providing or communicating an amount of oil to the undercrown portion 54, the check valve regulated squirter assembly 64 operates to cool the piston and lubricate the piston pin 34.

The plain orifice squirter 66 provides a projected oil flow in the presence of pressurized oil, whereas the check valve regulated squirter assembly 64 will provide a projected oil flow only when the oil pressure is above a predetermined opening pressure. An exemplary check valve regulated squirter assembly 64 would have an opening pressure of approximately 2 bar and include an orifice 98 with a diameter of 4 mm. Additionally, an exemplary plain orifice squirter 66 would have a nozzle portion 72 with a diameter of 1.5 mm. A connecting rod 14 with the above specifications would have a combined oil flow of approximately 1.02 liters/minute of oil at a temperature of 100 degrees Celsius and an engine speed of 5,600 RPM. Those skilled in the art will recognize that these values are merely exemplary in nature and are not meant to limit that which is claimed.

The orientation of the check valve regulated squirter assembly 64 and the plain orifice squirter 66 are chosen such that the projected stream 100 of oil impinges on the desired target, such as the undercrown 54 of the piston 16. The orientation of the squirter should be recalculated for each engine application.

The type of squirter, i.e. the check valve regulated squirter or plain orifice squirter, and the number of squirters will depend on the desired amount of piston cooling. For some applications, a single squirter will provide the flow necessary to sufficiently effect piston cooling.

While the best modes for carrying out the invention have been described in detail, those familiar with the art to which this invention relates will recognize various alternative designs and embodiments for practicing the invention within the scope of the appended claims.

The invention claimed is:

1. A connecting rod comprising:

a connecting rod body having a crank arm bore portion at a first end and a pin bore portion at a second end;

a beam portion connecting said crank arm bore portion and said pin bore portion;

at least two oil squirters provided within said crank arm bore portion, said at least two oil squirters being operable to selectively communicate oil to the underside of a piston;

wherein one of said at least two oil squirters is one of a plain orifice oil squirter and a check valve regulated oil squirter;

wherein the connecting rod is interconnectable to a crankshaft defining a pressurized oil passage;

wherein said crank arm bore portion is mountable to a rod journal of said crankshaft via a journal bearing having at least two orifices defined therein, each of said at least two orifices being operable to selectively communicate pressurized oil from said pressurized oil passage through said journal bearing to a respective one of said at least two oil squirters; and wherein said one of said at least two oil squirters is disposed on one side of said beam portion and another of said at least two oil squirters is disposed on another side of said beam portion.

2. The connecting rod of claim 1, wherein said one of said at least two oil squirters is a plain orifice squirter including a generally tapering bore operable to communicate pressurized oil to a generally cylindrical bore, said generally cylindrical bore being operable to communicate pressurized oil to a generally cylindrical nozzle portion.

3. The connecting rod of claim 1, wherein said one of said at least two oil squirters is a check valve regulated oil squirter including a spring biased ball member operable to selectively communicate pressurized oil when the pressure of the pressurized oil reaches a threshold value.

4. A connecting rod comprising:

a connecting rod body having a crank arm bore portion at a first end and a pin bore portion at a second end;

a beam portion connecting said crank arm bore portion and said pin bore portion;

at least one oil squirter provided within said crank arm bore portion, said at least one oil squirter being operable to selectively communicate oil to the underside of a piston;

wherein said at least one oil squirter is one of a plain orifice squirter and a check valve regulated squirter; and wherein said plain orifice squirter includes a generally tapering bore operable to communicate pressurized oil to a generally cylindrical bore, said generally cylindrical bore being operable to communicate pressurized oil to a generally cylindrical nozzle portion.

5. The connecting rod of claim 4, wherein the connecting rod is interconnectable to a crankshaft.

6. The connecting rod of claim 4, wherein said generally cylindrical bore has a greater radial dimension than said generally cylindrical nozzle portion.

7. The connecting rod of claim 4, wherein said check valve regulated squirter includes a spring biased ball member operable to selectively allow pressurized oil to pass when the pressure of the pressurized oil reaches a threshold value.

8. The connecting rod of claim 4, wherein said check valve regulated squirter includes a valve body having a generally cylindrical outer surface and a generally cylindrical bore defined therein, said generally cylindrical bore containing a coil spring operable to bias a ball member against said valve body to selectively allow the flow of pressurized oil.

9. The connecting rod of claim 8, wherein said check valve regulated squirter includes an expander pin insertable into said valve body and sufficiently configured to expand said generally cylindrical outer surface against said crank arm bore portion thereby securing said check valve regulated squirter within the connecting rod.

10. The connecting rod of claim 4, wherein said crank arm bore portion is mounted to a rod journal of a crankshaft via a journal bearing having at least one orifice defined therein, said crankshaft having a passage operable to selectively communicate pressurized oil to each of said at least one orifice, said each of said at least one orifice being operable to selectively communicate pressurized oil through said journal bearing to a respective one of said at least one oil squirter.

11. A connecting rod assembly mountable to a rod journal of a crankshaft having a passage defined therein, the connecting rod assembly comprising:

a connecting rod body having a crank arm bore portion at a first end and a pin bore portion at a second end;

a beam portion connecting said crank arm bore portion and said pin bore portion;

at least one oil squirter provided within said crank arm bore portion, said at least one oil squirter being operable to selectively communicate oil to the underside of a piston;

wherein said at least one oil squirter is one of a plain orifice oil squirter and a check valve regulated oil squirter; and wherein said crank arm bore portion is mountable to the rod journal of the crankshaft via a journal bearing having at least one orifice defined therein, the passage defined by the crankshaft being operable to selectively communicate pressurized oil to each of said at least one orifice, said at least one orifice being operable to selectively communicate pressurized oil through said journal bearing to a respective one of said at least one oil squirter.

12. The connecting rod of claim 11, wherein said at least one oil squirter is a plain orifice oil squirter including a generally tapering bore operable to communicate pressurized oil to a generally cylindrical bore, said generally cylindrical bore being operable to communicate pressurized oil to a generally cylindrical nozzle portion.

13. The connecting rod of claim 11, wherein said at least one oil squirter is a check valve regulated oil squirter including a spring biased ball member operable to further selectively communicate pressurized oil to the underside of said piston when the pressure of the pressurized oil reaches a threshold value.

14. The connecting rod of claim 11, wherein said at least one oil squirter is a check valve regulated oil squirter provided within said crank arm bore portion, said check valve regulated oil squirter including a valve body having a generally cylindrical outer surface and a generally cylindrical bore defined therein, said generally cylindrical bore containing a coil spring operable to bias a ball member against said valve body to further selectively communicate pressurized oil to the underside of said piston.

15. The connecting rod of claim 14, including an expander pin insertable into said valve body and sufficiently configured to expand said generally cylindrical outer surface against said crank arm bore portion thereby securing said check valve regulated squirter within the connecting rod.

* * * * *